US005790020A

United States Patent [19]

Sasagawa et al.

[11] Patent Number: 5,790,020

[45] Date of Patent: Aug. 4, 1998

[54] E.A.S. SYSTEM WITH SELECTIVE DISABLING

[75] Inventors: Shinichi Sasagawa; Seishi Namioka; Noboyuki Ichimiya; Shin Kinouchi, all of Miyagi-ken, Japan

[73] Assignee: Alps Electric Co., Ltd., Tokyo, Japan

[21] Appl. No.: 626,227

[22] Filed: Mar. 29, 1996

[30] Foreign Application Priority Data

Apr. 7, 1995 [JP] Japan ..... 7-082775

[51] Int. Cl.[6] ..... G08B 13/187

[52] U.S. Cl. ..... 340/572; 340/501; 340/568

[58] Field of Search ..... 340/572, 568, 340/501

[56] References Cited

U.S. PATENT DOCUMENTS 4,573,042 2/1986 Boyd et al. ..... 340/539

5,172,098 12/1992 Leydens et al. ..... 340/568

5,379,023 1/1995 Dalton ..... 340/568

*Primary Examiner*—Glen Swann

*Attorney, Agent, or Firm*—Guy W. Shoup

[57] ABSTRACT

An electronic article surveillance system includes a main apparatus; one or more relays connected to the main apparatus through cables; and one or more tags which are connected to the relays through cables. Each relay includes a resistance variation detecting section for successively detecting the resistance variation of one or more tags and for producing detection data; a data comparing section for comparing data prestored in memory with the detection data; a warning generating section for generating a warning when there is no coincidence in the comparison; and a tag surveillance operation stop section for stopping the warning generating operation for the subject relay or for a specific tag from among one or more the tags in response to an external control signal. An electronic article surveillance system is provided which is capable of selectively stopping the generation of the warning associated with the tag to be removed in situ when the tag is removed from the merchandise article for a proper reason.

3 Claims, 3 Drawing Sheets

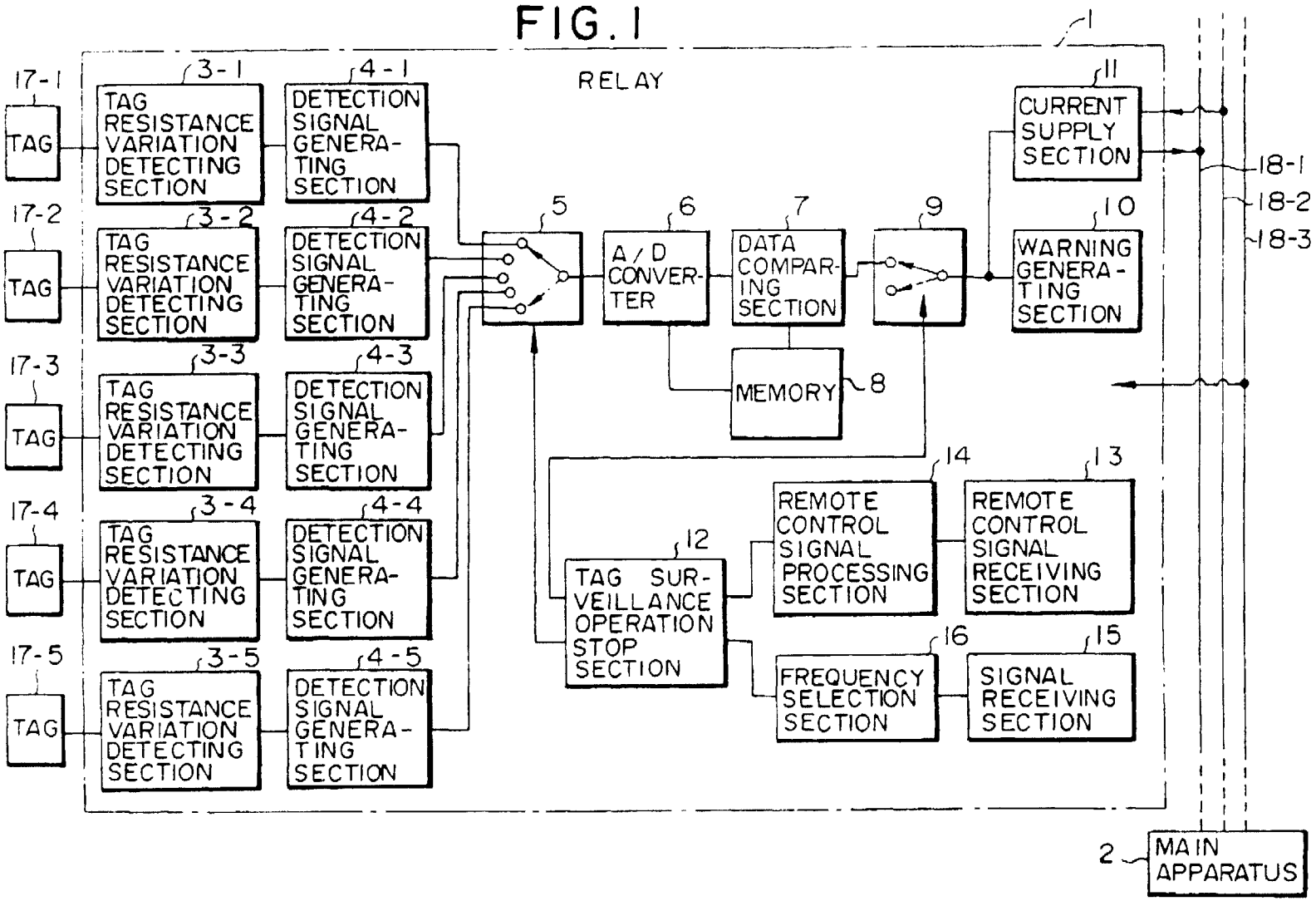
FIG. 1
RELAY
1
2
MAIN APPARATUS
18-1
18-2
18-3
11
CURRENT SUPPLY SECTION
10
WARNING GENERA-TING SECTION
9
7
DATA COMPAR-ING SECTION
8
MEMORY
6
A/D CONVER-TER
5
13
REMOTE CONTROL SIGNAL RECEIVING SECTION
15
SIGNAL RECEIVING SECTION
14
REMOTE CONTROL SIGNAL PROCESSING SECTION
16
FREQUENCY SELECTION SECTION
12
TAG SUR-VEILLANCE OPERATION STOP SECTION
4-1
DETECTION SIGNAL GENERA-TING SECTION
4-2
DETECTION SIGNAL GENERA-TING SECTION
4-3
DETECTION SIGNAL GENERA-TING SECTION
4-4
DETECTION SIGNAL GENERA-TING SECTION
4-5
DETECTION SIGNAL GENERA-TING SECTION
3-1
TAG RESISTANCE VARIATION DETECTING SECTION
3-2
TAG RESISTANCE VARIATION DETECTING SECTION
3-3
TAG RESISTANCE VARIATION DETECTING SECTION
3-4
TAG RESISTANCE VARIATION DETECTING SECTION
3-5
TAG RESISTANCE VARIATION DETECTING SECTION
17-1
TAG
17-2
TAG
17-3
TAG
17-4
TAG
17-5
TAG

E.A.S. SYSTEM WITH SELECTIVE DISABLING

BACKGROUND OF THE INVENTION

1. Field of the Invention

The present invention relates to an electronic article surveillance system (hereinafter referred to as an E.A.S. system). More particularly, the present invention relates to an E.A.S. system in which a relay is connected to a plurality of tags attached to merchandise articles, wherein the theft surveillance operation of the relay is terminated for a tag removed for a proper reason without terminating the theft surveillance operation for the other tags connected to the relay.

2. Description of the Related Art

Hitherto, an E.A.S. system has already been known in which tags are individually attached to a number of merchandise articles or the like, wherein these tags are grouped and connected to a plurality of relays, a plurality of these relays are connected to a main apparatus through cables, and the fact that one or more of a number of tags are removed from the merchandise articles or the like is notified by generating a warning sound.

FIG. 2 is a block diagram illustrating an example of each relay in such a known E.A.S. system. FIG. 3 is a block diagram illustrating an example of a main apparatus also in such a known E.A.S. system.

As shown in FIG. 2, a relay 30 comprises a plurality of tag resistance variation detection sections 31-1 to 31-6, a plurality of detection signal generating sections 32-1 to 32-6, a coupling circuit 33, a data comparing section 34, a memory 35, a warning generating section 36, and a current supply section 37. In this case, the tag resistance variation detection sections 31-1 to 31-6 are connected to the detection signal generating sections 32-1 to 32-6, respectively, an input of each of which corresponds to an output from each of mutually different tags 38-1 to 38-6 through cables (no reference numerals are provided). The outputs of the detection signal generating sections 32-1 to 32-6 are connected to mutually different inputs of the coupling circuit 33, and the common output of the coupling circuit 33 is connected to the data comparing section 34. The data comparing section 34 is connected to the warning generating section 36 and the current supply section 37. The current supply section 37 is connected to a main apparatus 40 shown in FIG. 3 through cables 39-1 and 39-2. The relay 30 and the main apparatus 40 are connected to each other through a power-supply cable 39-3. The tags 38-1 to 38-6 are attached to mutually different merchandise articles or the like, and the internal resistance of each of the tags 38-1 to 38-6 reaches a value of approximately 5 to 20 KΩ.

As shown in FIG. 3, the main apparatus 40 comprises a current value detection section 41, an analog-to-digital converter 42, a data comparing section 43 on the main unit side, a memory 44 on the main unit side, a warning generating section 45 on the main unit side, and a power-supply unit 46. In this case, an input is provided to the current value detection section 41 through the cables 39-1 and 39-2, and an output therefrom is provided to the analog-to-digital converter 42. The data comparing section 43 on the main unit side is connected to the output of the analog-to-digital converter 42, the memory 44 on the main unit side, and the warning generating section 45 on the main unit side. Further, the power-supply unit 46 is connected to the other cable 39-3.

The known E.A.S. system having the above-described construction operates roughly as described below.

On the relay 30 side, the internal resistances of the tags 38-1 to 38-6 attached to mutually different merchandise articles or the like are continuously monitored by the tag resistance variation detection sections 31-1 to 31-6, respectively. The detection signal generating sections 32-1 to 32-6 each generate a detection signal indicative of the detected result of each resistance value of the tag resistance variation detection sections 31-1 to 31-6. These detection signals are coupled by the coupling circuit 33, such as a wired OR circuit, are formed into a coupled detection signal, and supplied to the data comparing section 34 which is connected posteriorly. The data comparing section 34 compares the value of the coupled detection signal which is supplied from the coupling circuit 33 with the set value which is prestored in the memory 35.

In this case, if it is assumed that each of the tags 38-1 to 38-6 is attached to mutually different merchandise articles or the like, the internal resistance of each of the tags 38-1 to 38-6 reaches a value of approximately 5 to 20 KΩ. These internal resistances are detected by the tag resistance variation detection sections 31-1 to 31-6, wherein a detection signal having substantially the same magnitude is output from each of the detection signal generating sections 32-1 to 32-6, and the value of the coupled detection signal obtained as a result of the coupling of those detection signals by the coupling circuit 33 is substantially the same as the value of the aforementioned detection signal and is substantially the same as the set value prestored in the memory 35. Therefore, the data comparing section 34 generates a signal indicating that the value of the coupling circuit detection signal coincides with the set value of the memory 35. This coincidence signal is fed to the warning generating section 36 and the current supply section 37 which are connected posteriorly. However, the warning generating section 36 does not respond to this coincidence signal and does not generate a warning. The current supply section 37 also does not respond to this coincidence signal and does not supply a large current output to the main apparatus 40 side.

On the other hand, in a case in which at least one of the tags 38-1 to 38-6, e.g., the tag 38-1, is removed from the merchandise articles or the like, the internal resistance (the internal resistance including the connection cable) of the removed tag 38-1 side reaches a resistance value which greatly varies between 5 to 20 KΩ even if the tag 38-1 is removed with the connection cable being short-circuited or not short-circuited. This varied resistance value is detected by the detection signal generating section 32-1, a detection signal which is greatly varied from the detection signal of the same value obtained from the other detection signal generating sections 32-2 to 32-6 is output from the detection signal generating section 32-1, and this detection signal of the varied value is coupled with the other detection signals of the same value by the coupling circuit 33. At this time, the coupling circuit 33 generates a coupled detection signal of a value substantially equal to such detection signal of the varied value. However, since this coupled detection signal is considerably varied from the set value prestored in the memory 35, the data comparing section 34 generates an incoincidence signal indicating that the value of the coupled detection signal does not coincide with the set value of the memory 35. When this incoincidence signal is fed to the warning generating section 36 and the current supply section 37 which are connected posteriorly, the warning generating section 36 is caused to generate a warning in response to the incoincidence signal, and the current supply section 37, in response to the incoincidence signal, is also caused to supply a current output of a value larger than at normal time to the main apparatus 40 side via the cable 39-1.

On the main apparatus 40 side, the current value detection section 41 detects the current value supplied from a plurality of relays 30 which are connected through the cables 39-1 and 39-2, and generates a detection signal responsive to the current value. This detection signal is converted into a digital signal by the analog-to-digital converter 42 which is connected posteriorly and supplied to the data comparing section 43 on the main unit side.

In this case, during the time in which a current value of a normal magnitude is being supplied from all of the relays 30 which are connected to the main apparatus 40, that is, during the time in which the respective tags 38-1 to 38-6 which are connected to all of these relays 30 are attached to mutually different merchandise articles or the like, the value of the digital signal supplied to the data comparing section 43 on the main unit side is substantially the same as the set value which is prestored in the memory 44 on the main unit side. The data comparing section 43 on the main unit side produces a coincidence signal indicating that the value of the digital signal coincides with the set value of the memory 44 on the main unit side. This coincidence signal is fed to the warning generating section 45 on the main unit side which is connected posteriorly. However, the warning generating section 45 on the main unit side does not respond to this coincidence signal and does not generate a warning.

On the other hand, when a current value which is considerably larger than the current value of the normal magnitude begins to be supplied from at least one of all of the relays 30 which are connected to the main apparatus 40, that is, when at least one of the plurality of tags 38-1 to 38-6 which are connected to at least one of the relays 30 is removed from the merchandise articles or the like, the value of the digital signal which is supplied to the data comparing section 43 on the main unit side becomes considerably larger than the set value which is prestored in the memory 44 on the main unit side. Therefore, the data comparing section 34 on the main unit side produces an incoincidence signal indicating that the value of the digital signal does not coincide with the set value of the memory 44 on the main unit side. This incoincidence signal, when fed to the warning generating section 45 on the main unit side which is connected posteriorly, causes the warning generating section 45 on the main unit side to produce a warning in response to this incoincidence signal.

As described above, according to the known E.A.S. system, when at least one of the plurality of tags 38-1 to 38-6 which are connected to the respective plurality of relays 30 which constitute the E.A.S. system is removed from the merchandise articles or the like, the warning generating section 36 within the relay 30 and the warning generating section 45 within the main apparatus 40 generate warnings. Therefore, it is possible for a salesclerk or other member to prevent the merchandise articles or the like from being stolen due to the generation of these warnings.

In the above-described known E.A.S. system, in a case in which the tag which is attached to a merchandise article or the like is removed because the shopper purchases the merchandise article or the like, if the tag is simply removed, the internal resistance of the removed tag increases sharply. The sharp increase in the internal resistance, as described above, causes the incoincidence signal to be fed to the warning generating section 36 within the relay 30 and the warning generating section 45 within the main apparatus 40, and both the relay 30 and the main apparatus 40 generate warnings.

In order to eliminate such a generation of unnecessary warnings, in the known E.A.S. system, when the tag which is attached to the merchandise article or the like is removed for the proper reason, the salesclerk or other member moves to the place where the main apparatus 40 is disposed and switches off the main power of the main apparatus 40 in order to temporarily stop the warning surveillance operation of the E.A.S. system, after which the tag attached to the merchandise article or the like is removed.

In the above-described known E.A.S. system, in a case in which the tag attached to the merchandise article or the like is removed for the proper reason, as described above, the salesclerk or other member moves to the place where the main apparatus 40 is disposed and switches off the main power of the main apparatus 40. Therefore, each time a merchandise article or the like with a tag attached thereto is purchased, it is necessary for the salesclerk or other member to move all the way to the place where the main apparatus 40 is disposed. Thus, not only must a very inconvenient operation be performed by the shop personnel side, but also the shopper must wait during the period of performing such operation. Moreover, when the main power of the main apparatus 40 is switched off, the surveillance operation of the E.A.S. system is temporarily stopped during that time, and the theft surveillance of the merchandise article or the like cannot be performed.

SUMMARY OF THE INVENTION

The present invention solves the above-described problems. It is an object of the present invention to provide an E.A.S. system which is capable of selectively stopping the generation of the warning associated with the tag to be removed in situ when the tag is removed from the merchandise article for a proper reason.

To achieve the above-described object, the present invention provides an E.A.S. system comprising: a main apparatus; one or more relays connected to said main apparatus through cables; and one or more tags which are connected to said relays through cables, wherein each relay comprises a resistance variation detecting section for successively detecting the resistance variation of one or more tags which are connected to the relay and for producing detection data; a data comparing section for comparing the data prestored in memory with said detection data; a warning generating section for generating a warning when there is no coincidence in the comparison; and a tag surveillance operation stop section for stopping the warning surveillance operation for the subject relay or for a specific tag from among one or more said tags by supplying an external control signal.

In the above-described E.A.S. system, each of the relays which are connected to the merchandise articles through cables is provided with a tag surveillance operation stop section for selectively stopping the warning surveillance operation of the subject relay or the warning surveillance operation in respect of a specific tag from among a plurality of tags which are connected to the relay by supplying an external control signal. A remote control signal generator or the operation section of a external security control unit is provided which is operated by the salesclerk or other member. When a specific tag from among a plurality of tags which are connected to one relay is removed from the merchandise article or the like, the remote control signal produced from the remote control signal generator is supplied to the relay, or a signal of a specific frequency produced from the operation section of the external security control unit is supplied to the relay, and the tag operation stop section is operated in response to either the supplied remote control signal or the supplied signal of the specific frequency so that only the warning generation operation of the subject relay is temporarily stopped, or the warning generation operation in respect of the specific tag to be removed is temporarily stopped.

As described above, according to the above-described system, when a specific tag from among the tags connected to the relay is removed from the merchandise article or the like, the remote control signal generator or the operation section of the external security control unit which is operated by the salesclerk or other member to directly stop only the warning generation operation of the subject relay to which the specific tag is connected or that of of the specific tag. Therefore, there is no need for the salesclerk or other member to move to the main apparatus and switch off the main power. Thus, the labor of the salesclerk or other member for operating the E.A.S. system is reduced, the shopper does not need to wait, and the situation in which the entire E.A.S. system is temporarily placed in a surveillance inoperable state can be avoided.

The above and further objects, aspects and novel features of the invention will become more apparent from the following detailed description when read in connection with the accompanying drawings.

BRIEF DESCRIPTION OF THE DRAWINGS

FIG. 1 is a block diagram illustrating an embodiment of an E.A.S. system according to the present invention;

DETAILED DESCRIPTION OF THE PREFERRED EMBODIMENT

Figure 2:
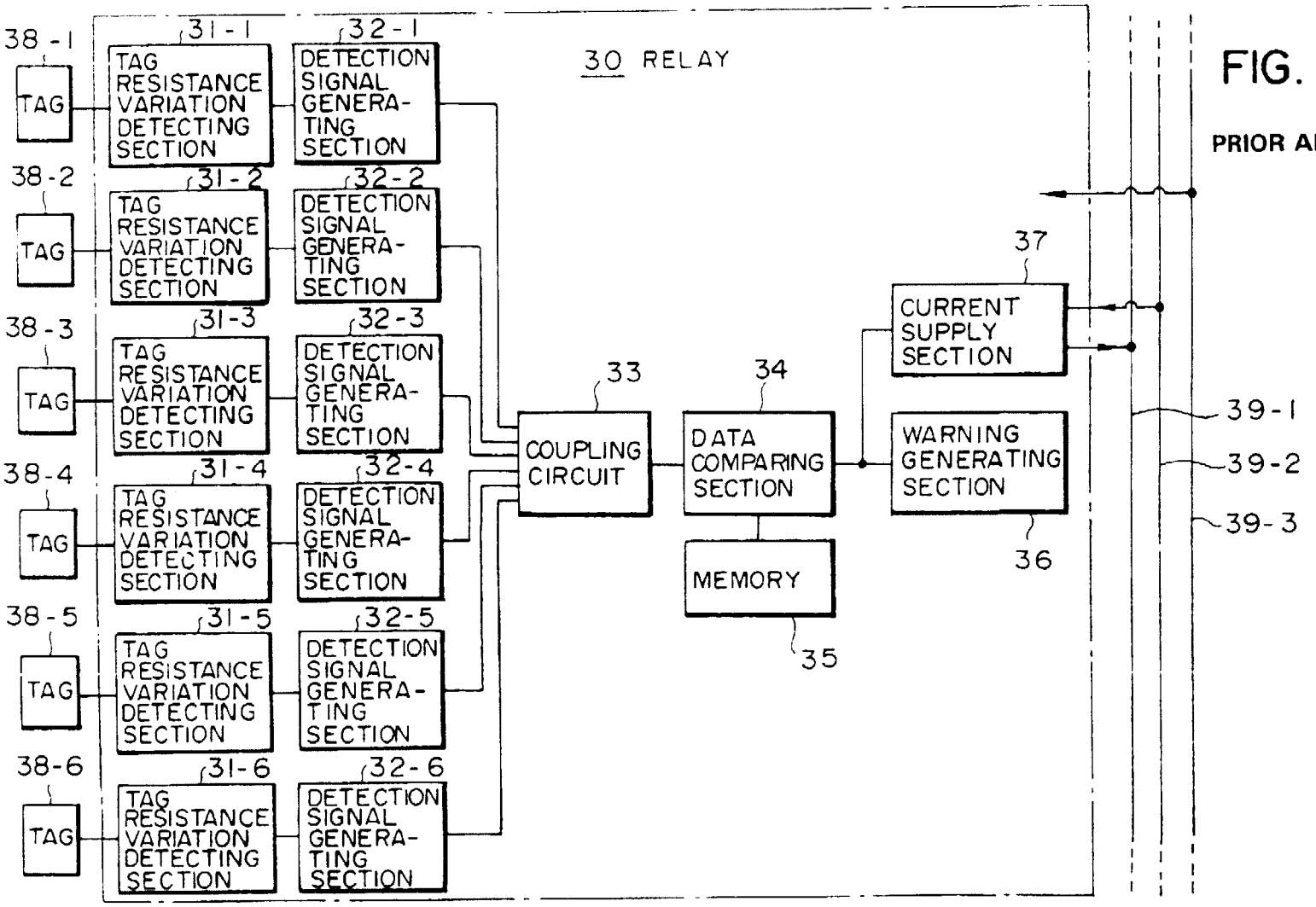
FIG. 2 PRIOR ART
FIG. 2 is a block diagram illustrating an example of a relay in a known E.A.S. system.

A preferred embodiment of the present invention will be described below with reference to the accompanying drawings.

FIG. 1 is a block diagram illustrating the essential portion of an embodiment of an E.A.S. system according to the present invention.

As shown in FIG. 1, the E.A.S. system comprises one or more relays (only one relay is shown in FIG. 1), and a common main apparatus 2. Each relay 1 comprises a plurality of tag resistance variation detecting sections 3-1 to 3-5, a plurality of detection signal generating sections 4-1 to 4-5, a tag selector switch 5, an analog-to-digital converter 6, a data comparing section 7, a memory 8, a signal selector switch 9, a warning generating section 10, a current supply section 11, a tag surveillance operation stop section 12, a remote control signal receiving section 13, a remote control signal processing section 14, a signal receiving section 15, and a frequency selection section 16.

The inputs of the tag resistance variation detecting sections 3-1 to 3-5 are connected to mutually different tags 17-1 and 17-5 through cables (no reference numerals are provided) and the outputs thereof are connected to detection signal generating sections 4-1 and 4-5, respectively. The outputs of the detection signal generating sections 4-1 and 4-5 are connected to mutually different inputs of the tag selector switch 5, and the output of the tag selector switch 5 are connected to the input of the analog-to-digital converter 6. The analog-to-digital converter 6 is connected to one of the inputs of the data comparing section 7 and to the memory 8. The other input of the data comparing section 7 is connected to the memory 8, and the output thereof is connected to one of the inputs of the signal selector switch 9. The other input of the signal selector switch 9 is opened, and the output thereof is connected to the warning generating section 10 and the current supply section 11. The current supply section 11 is connected to the main apparatus 2 through cables 18-1 and 18-2. One of the outputs of the tag surveillance operation stop section 12 is connected to the control end of the tag selector switch 5, and the other output is connected to the signal selector switch 9. One of the inputs of the tag surveillance operation stop section 12 is connected to the output of the remote control signal processing section 14, and the other input is connected to the output of the frequency selection section 16. Upon receiving a remote control signal supplied from outside, the output of the remote control signal receiving section 13 is fed to the input of the remote control signal processing section 14. Upon receiving a frequency signal supplied from outside, the output of the signal receiving section 15 is fed to the input of the frequency selection section 16. A power supply cable 18-3 is connected between the relay 1 and the main apparatus 2. Power is supplied to the relay 1 through the cable 18-3. In this case, the respective tags tags 17-1 and 17-5 are attached to mutually different merchandise articles or the like, and all the internal resistances of the tags 17-1 and 17-5 attached to merchandise articles or the like reach values from approximately 5 to 20 KΩ.

Figure 3:
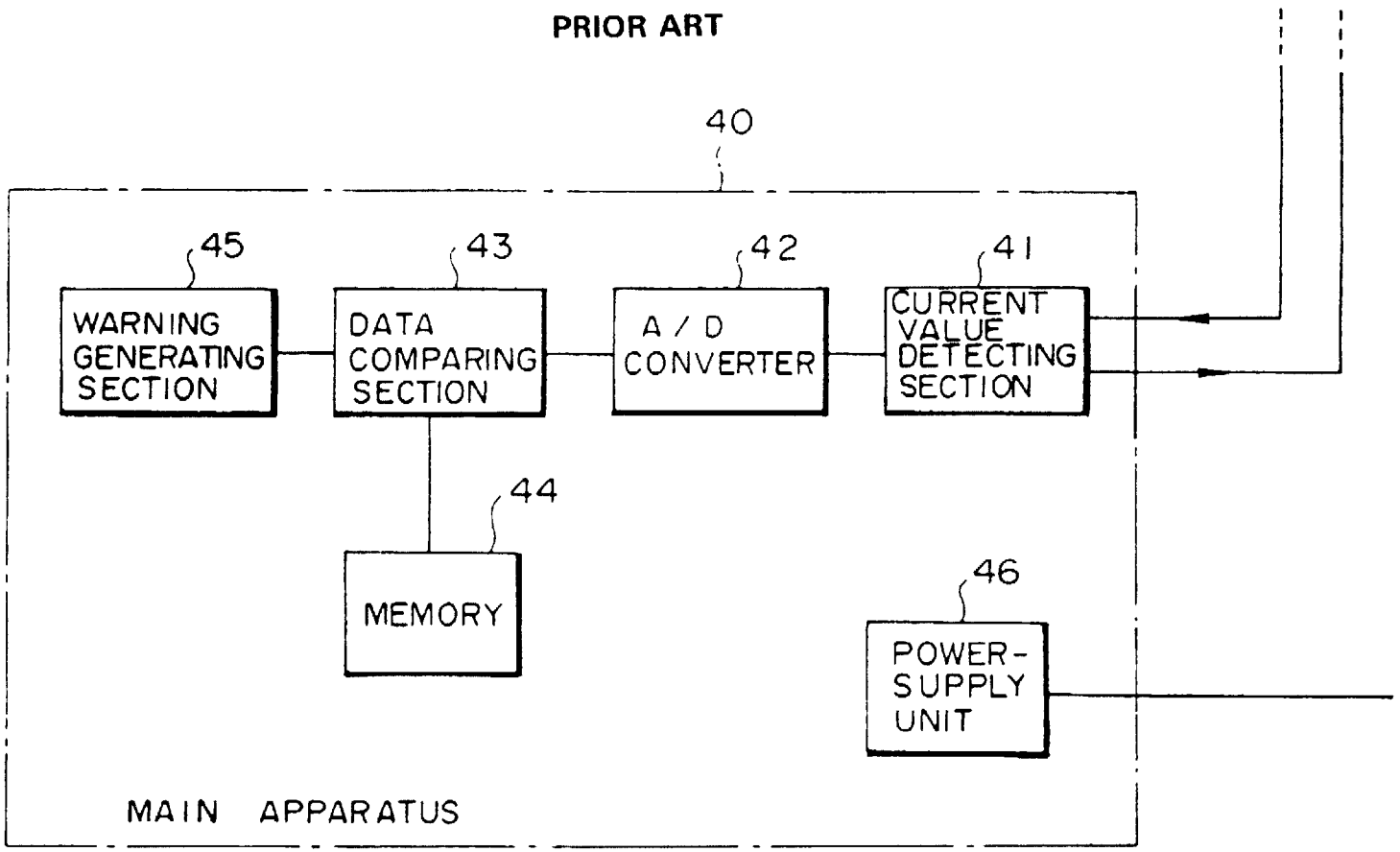
FIG. 3 PRIOR ART
FIG. 3 is a block diagram illustrating an example of a main apparatus in the known E.A.S. system.

Although a detailed block diagram of the main apparatus 2 is not shown in FIG. 1, known components shown in FIG. 3 are used for the main apparatus 2.

The E.A.S. system of this embodiment having the above-described construction operates as described below.

First, a theft surveillance operation using a plurality of tags 17-1 and 17-5 will be described.

The internal resistances of the tags 17-1 and 17-5 which are attached to mutually different merchandise articles or the like are continuously detected by the tag resistance variation detecting sections 3-1 to 3-5, respectively. The detection signal generating sections 4-1 to 4-5 each generate detection signals responsive to the resistance value detection results of the tag resistance variation detecting sections 3-1 to 3-5. These detection signals are extracted in sequence on a time division basis by the tag selector switch 5 which is connected posteriorly. The signals which are extracted on a time division basis are converted into digital signals by the analog-to-digital converter 6 which is connected posteriorly, and supplied to the data comparing section 7. The data comparing section 7 compares the value of the digital signal supplied in sequence on a time division basis from the analog-to-digital converter 6 with the digital set value which is prestored in the memory 8.

In this case, if it is assumed that the tags 17-1 and 17-5 are attached to mutually different merchandise articles or the like, the internal resistances of the tags 17-1 and 17-5 each have a value from approximately 5 to 20 KΩ. These internal resistances are detected by the tag resistance variation detecting sections 3-1 to 3-5, and a detection signal of substantially the same magnitude is output from each of the detection signal generating sections 4-1 to 4-5. These detection signals of the same magnitude are extracted in sequence on a time division basis by the tag selector switch 5, and converted into digital signals by the analog-to-digital converter 6. Each of the values of the digital signals extracted in sequence on a time division basis is substantially the same, and also is substantially the same as the digital set value which is prestored in the memory 8. Therefore, the data comparing section 7 produces a coincidence signal indicating that the value of the input digital signal coincides with the digital set value of the memory 8. Then, this coincidence signal is fed to the warning generating section 10 and the current supply section 11. However, the warning generating section 10 does not respond to this coincidence signal and does not generate a warning, and the current supply section 11 does not respond to this coincidence signal and does not supply a large current output to the main apparatus 2 side.

On the other hand, if at least one of the tags 17-1 and 17-5, e.g., the tag 17-1, has been removed from the merchandise article or the like, the internal resistance of the removed tag 17-1 reaches a value considerably varied from 5 to 20 KΩ, this varied resistance value is detected by the detection signal generating section 3-1, and a detection signal of a value varied from the detection signals of the same value obtained by the other detection signal generating sections 4-2 to 4-5 is output from the detection signal generating section 4-1. This detection signal of the varied value is supplied to the tag selector switch 5 together with the aforementioned detection signal of the same value and extracted in sequence on a time division basis, after which the signal is converted into a digital signal by the analog-to-digital converter 6 and supplied to the data comparing section 7. At this time, the digital signal supplied to the data comparing section 7 contain a digital signal of a value varied from the same value in the digital signals of the same value, and the digital signal of the varied value is considerably varied from the digital set value which is prestored in the memory 8. Therefore, data comparing section 7 produces an incoincidence signal indicating that the value of the input digital signal does not coincide with the digital set value of the memory 8. Then, when this incoincidence signal is fed to the warning generating section 10 and the current supply section 11, the warning generating section 10, in response to this incoincidence signal, generates a warning, and the current supply section 11, in response to this incoincidence signal, supplies a current output of a value larger than at the normal time to the main apparatus 2 side through the cable 18-1.

In the main apparatus 2, when a current output of the normal magnitude is being supplied from all of the relays 1 which are connected to the main apparatus 2 through the cable 18-1, the warning generating section 45 (FIG. 3) on the main unit side does not operate and does not generate a warning in the same way as in the main apparatus 40 shown in FIG. 3. However, if a current output of a value larger than at the normal time is supplied from any of the relays 1 through the cable 18-1, the warning generating section 45 operates to generate a warning in the same way as in the main apparatus 40 shown in FIG. 3.

As described above, according to the E.A.S. system of this embodiment, when at least one of the plurality of tags 17-1 and 17-5 which are connected to the plurality of relays 1 respectively which constitute the E.A.S. system, e.g., the tag 17-1, is removed from the merchandise article or the like, both the warning generating section 10 within the relay 1 and the warning generating section 45 within the main apparatus 40 generate warnings. Therefore, it is possible for a salesclerk or other member to prevent the merchandise articles or the like from being stolen due to the generation of these warnings.

Next, in the embodiment shown in FIG. 1, a description will be given of the operation for stopping the generation of warnings and surveillance on the relay 1 side and the main apparatus 2 side, when a tag is removed from the merchandise article or the like for a proper reason. In this embodiment, a case in which only the theft surveillance operation in respect of the tag to be removed will be explained.

In a case in which a merchandise article or the like to which one tag from among a plurality of tags 17-1 and 17-5 which are connected to the relay 1, e.g., the tag 17-1, is purchased by a shopper, and thus the tag 17-1 must be removed from the merchandise article or the like by the salesclerk or other member, the salesclerk or other member directs a remote control signal generator (not shown in FIG. 1) toward the remote control signal receiving section side, and presses the signal generation button thereof to generate a remote control signal. At this time, the generated remote control signal is received by the remote control signal receiving section 13 of the relay 1, and the signal processing section 14 checks if it is a correct remote control signal. When it is a correct remote control signal, the signal processing section 14 performs predetermined signal processing, such as amplification or waveform shaping, and supplies the signal to the tag surveillance operation stop section 12 as a first control signal. Upon receiving the first control signal, the tag surveillance operation stop section 12 varies the switching signal which is supplied to the control end of the tag selector switch 5, so that the way in which the detection signals supplied from all of the detection signal generating sections 4-1 and 4-5 are switched in sequence and selected as is done before is changed to a way in which the detection signals supplied from the other detection signal generating sections 4-2 and 4-5 are switched in sequence and selected without making a selection of the detection signal from the detection signal generating section 4-1.

For this reason, even if the tag 17-1 is removed from the merchandise article or the like, the internal resistance of the tag 17-1 varies greatly, and a detection signal of a large value is sent out to the detection signal generating section 4-1, an incoincidence signal is not output to the output side of the data comparing section 7 because the detection signal of the varied value is not selected by the tag selector switch 5. Thus, no such things occur: the warning generating section 10 within the relay 1 operates to generate a warning, and the current supply section 11 supplies a current output of a large value to the main apparatus 2 side, causing the warning generating section 45 within the main apparatus 2 to operate to generate a warning.

The above description is concerned with a case in which the tag 17-1 is removed from the merchandise article or the like. The same applies as well to a case in which other tags, e.g., the tag 17-12 or tag 17-3, is removed from the merchandise article or the like, and the tag 17-12 or tag 17-3 which is removed from the merchandise article or the like will not be selected by the tag selector switch 5. When the tag which will not be selected by the tag selector switch 5 is selected by a remote control signal, the tag may be selected in sequence in accordance with the number of times the remote control signal is generated, or the tag may be selected in accordance with a variation in the waveform or the like of the remote control signal to be sent out according to a selection of an operation button or the like.

Next, a description will be given of another operation for stopping the warning generation and surveillance on both the relay 1 side and the main apparatus 2 side when a tag is removed from a merchandise article or the like for a proper reason, here, an operation for stopping the warning generation and surveillance of the subject relay 1.

As described above, in a case where a merchandise article or the like to which one of the tags from among a plurality of the tags 17-1 and 17-5 which are connected to the relay 1, e.g., the tag 17-1, is attached, is purchased by a shopper, and the salesclerk or other member needs to remove this tag 17-1 from the merchandise article or the like, the salesclerk or other member connects the output section of the external security control unit (not shown in FIG. 1) to the signal receiving section 15 of the relay 1, and operates the operation section thereof in order to cause the security unit to generate a frequency signal. At this time, the generated frequency signal is supplied from the signal receiving section 15 of the relay 1 to the frequency selection section 16 where a check is made to determine if it is a correct frequency signal. When it is a correct frequency signal, predetermined signal processing, such as amplification or waveform shaping, is performed on the signal, and supplied to the tag surveillance operation stop section 12 as a second control signal. Upon receiving the second control signal, the tag surveillance operation stop section 12 varies the switching signal supplied to the control end of the signal selector switch 9 so as to switch and connect the movable contact point of the signal selector switch 9 which has been switched and connected to the output side of the data comparing section 7 until then to the open end side so that the coincidence signal or incoincidence signal output from the data comparing section 7 is not transmitted to the warning generating section 10 or the current supply section 11 side.

For this reason, even if the tag 17-1 is removed from the merchandise article or the like, the internal resistance of the tag 17-1 varies greatly, the detection signal of the varied value is sent out to the detection signal generating section 4-1, causing an incoincidence signal to be output on the output side of the data comparing section 7, the incoincidence signal is suppressed by the signal selector switch 9, and therefore no such things occur: the warning generating section 10 within the relay 1 operates to generate a warning, or the current supply section 11 sends out a current output of a large value to the main apparatus 2 side, causing the warning generating section 45 within the main apparatus 2 to operate to generate a warning.

In this embodiment, the frequency signal which is output from the external security control unit is used by which the frequencies f, 2 f, 4 f, 8 f, and 16 f are selectively output by switching. The frequency selection section 16 is designed to select one frequency from among the above frequencies f, 2 f, 4 f, 8 f, and 16 f. When the frequency selected by the frequency selection section 16 is, for example, 2 f, the frequency may be selected so that the output frequency of the external security control unit used for this relay 1 is 2 f.

It is clear that also in this embodiment the operation which is the same as that described above is performed for a case in which a tag other than the tag 17-1, e.g., the tag 17-2 or 17-3, is removed from the merchandise article or the like.

As described above, according to this embodiment, in a case in which any one of the a plurality of tags 17-1 and 17-5 which are connected to the relay 1 is removed for a proper reason, the warning generation and surveillance operation in respect of the tag to be removed or the warning generation and surveillance operation of the subject relay 1 can be stopped by mere operation of the remote control signal generator or the operation section of the external security control unit by the salesclerk or other member. Therefore, there is no need for the salesclerk or other member to move to the main apparatus 1 and switch off the main power thereof each time the tag is removed. Thus, the labor of the salesclerk or other member for operating the E.A.S. system is reduced, the shopper does not need to wait, and the situation in which the entire E.A.S. system is temporarily placed in a surveillance inoperable state can be avoided.

Although the above-described embodiment describes an example in which the number of tags 17-1 and 17-5 which are connected to the relay 1 is five, it is clear that the present invention is not limited to a case in which the number of tags connected to the relay 1 is five, and the relay may be connected to one or more tags.

As has been described in detail up to this point, according to the present invention, when a specific tag from among the tags 17-1 and 17-5 which are connected to the relay 1, e.g., the tag 17-1, is removed from the merchandise article or the like, a remote control signal generator or the operation section of a external security control unit which is operated by a salesclerk or other member is used to directly stop temporarily only the warning generation operation of the subject relay 1 to which the specific tag 17-1 is connected or warning generation operation in respect of the specific tag 17-1. Therefore, there is no need for the salesclerk or other member to move to the main apparatus 2 and switch off the main power each time the tag 17-1 is removed. Thus, the labor of the salesclerk or other member for operating the E.A.S. system is reduced, the shopper hardly needs to wait, and the situation in which the entire E.A.S. system is temporarily placed in a surveillance inoperable state can be avoided.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An electronic article surveillance system, comprising:

a main apparatus;

one or more relays connected to said main apparatus through cables; and one or more tags which are connected to said relays through cables, wherein each said relay comprises:

a resistance variation detecting section for successively detecting the resistance variation of one or more tags which are connected to said relay and for producing detection data;

a data comparing section for comparing data prestored in memory with said detection data;

a warning generation section for generating a warning when there is not coincidence in the comparison; and a tag surveillance operation stop section for stopping the warning generating operation for the subject relay or for a specific tag from among one or more of said tags in response to an external control signal.

2. An electronic article surveillance system according to claim 1, wherein said external control signal is a remote control signal which is supplied from an external remote control signal generator, and this remote control signal is received by a remote control signal receiving section and then processed by a remote control signal processing section and supplied to said tag surveillance operation stop section.

3. An electronic article surveillance system according to claim 1, wherein said external control signal is a signal of a specific frequency supplied from an external security control unit, this signal of the specific frequency is received by a signal receiving section, and then the frequency is selected by a frequency selection section and supplied to said tag surveillance operation stop section.

* * * * *